US005769352A

United States Patent [19]

Biagiotti

[11] Patent Number: 5,769,352

[45] Date of Patent: Jun. 23, 1998

[54] WEB REWINDING MACHINE, ADAPTABLE TO DIFFERENT CORE DIAMETERS

[75] Inventor: Guglielmo Biagiotti, Capannori, Italy

[73] Assignee: Fabio Perini S.p.A., Lucca, Italy

[21] Appl. No.: 750,286

[22] PCT Filed: Jun. 7, 1995

[86] PCT No.: PCT/IT95/00098

§ 371 Date: Dec. 2, 1996

§ 102(e) Date: Dec. 2, 1996

[87] PCT Pub. No.: WO95/34498

PCT Pub. Date: Dec. 21, 1995

[30] Foreign Application Priority Data

Jun. 16, 1994 [IT] Italy ..... FI94A0124

[51] Int. Cl.[6] ..... B65H 18/20; B65H 19/30

[52] U.S. Cl. ..... 242/521; 242/542.2

[58] Field of Search ..... 242/521, 526.1, 242/542, 542.1, 542.2

[56] References Cited

U.S. PATENT DOCUMENTS

| | | | |
|---|---|---|---|
| 4,327,877 | 5/1982 | Perini . | |
| 4,909,452 | 3/1990 | Hertel et al. | 242/521 |
| 5,104,055 | 4/1992 | Buxton | 242/542 |
| 5,137,225 | 8/1992 | Biagiotti . | |
| 5,421,536 | 6/1995 | Hertel et al. | 242/526.1 |
| 5,505,405 | 4/1996 | Vigneau | 242/542.1 |

FOREIGN PATENT DOCUMENTS

| | | |
|---|---|---|
| 498039 | 8/1992 | European Pat. Off. . |
| 524158 | 1/1993 | European Pat. Off. . |
| 2544701 | 10/1984 | France . |

*Primary Examiner*—John M. Jillions
*Attorney, Agent, or Firm*—Breiner & Breiner

[57] ABSTRACT

A rewinding machine for the formation of logs (L) of web material (N) wound on a core (A) comprises: a first winding roller (15) around which the web material (N) is run; a second winding roller (17) forming, together with the first winding roller (15), a nip (19); a feeder for feeding the web material into the nip (19); an insertion device (89) to insert a core (A) on which the web material (N) is to be wound; and, before the nip (19), with respect to the direction of advance of the web material (N), a deformable or oscillating rolling surface (33) forming, together with the feeder, a channel (39) into which the core (A) is inserted; and a device (73) for interrupting the web material (N), interacting with the feeder in an intermediate position along the channel (39), between the point of insertion of the new core and the nip (19).

22 Claims, 5 Drawing Sheets

1
11
7
9
13
5
N
21
L
81
A
87
15
81
A
85
T1
T2
77
79
83
49
53
89
35
33
17
89A
19
31
81
50
39
17A
47
71
57
40
37
41
73
71A
55
C
F1
F2
43
45
63
61

WEB REWINDING MACHINE, ADAPTABLE TO DIFFERENT CORE DIAMETERS

DESCRIPTION

1. Technical Field

The invention relates to a rewinding machine for the formation of rolls or logs of web material, for example and in particular a web of paper for the production of rolls of toilet paper, rolls of absorbent paper for domestic use, industrial rolls, and similar.

More particularly, the invention relates to automatic peripheral rewinding machines in which rewinding takes place at least partially with the roll or log in formation in contact with a system of rotating winding rollers.

2. Background Art

There are many different types of automatic peripheral rewinding machines which differ from each other in particular in the system of cutting or interrupting the web material at the end of a winding cycle to initiate the following winding cycle.

Automatic peripheral rewinding machines are known, for example, from U.S. Pat Nos. 4,487,377, 4,723,724, 4,828,195 and 5,137,225.

A rewinder with a particularly simple and efficient system for interrupting the web material at the end of each individual winding is described in patent application PCT/IT94/00031, with the priority of Italian patent application No. FI93A000058, the contents of which form an integral part of the present description. Machines corresponding to the description in the two patent applications cited above are produced and sold by the applicant under the trade name of SINCRO (registered trade mark).

The rewinding machine described in PCT/IT94/00031 has

- a first winding roller around which the web material is run;
- a second winding roller forming, together with the first winding roller, a nip through which the core and the web material are made to pass;
- means of feeding the web material into the said nips these means having a speed of advance substantially equal to the speed of feeding of the web material;
- insertion means to insert a core on which the web material is to be wound;
- before the said nip with respect to the direction of advance of the web material, a rolling surface forming, together with the means of feeding the web material, a channel into which the core is inserted;
- a means of interrupting the web material, interacting with the said means of feeding the web material in an intermediate position along the said channel, between the point of insertion of the new core and the said nip.

The object of the present invention is to provide an improvement of the machine described in application PCT/IT94/00031, which makes the machine particularly versatile in respect of the variation of the diameter of the winding core on which the roll is wound, and which makes it possible, with minimal intervention and without replacement of parts, to change from the production of logs with a tubular core of a certain diameter to the production of logs with a tubular core with a diameter which is greater or lesser, possibly by several tens of millimetres.

DISCLOSURES OF INVENTION

Essentially, according to the invention, the rolling surface forming the said channel is made at least partially with an oscillating cradle.

More particularly, in a preferred embodiment, the rolling surface forming the channel before the nip between the first and second winding rollers is divided into two, or preferably three parts: the first is the area of insertion of the cores, in a fixed position with respect to the insertion means; the second is formed by the said oscillating cradle; and the third is formed by a linking surface which is fixed with respect to the axis of the second winding roller. In this way a core, after insertion, advances in the channel formed by the oscillating rolling surface, which may oscillate by yielding elastically in such a way that the size of the channel is adapted to the diameter of the core, which may therefore vary over a fairly wide range of diameters. Before entering the nip delimited by the winding rollers, the core (with the web material which is being wound on it) passes from the oscillating cradle to the linking surface which, being fixed with respect to the second winding roller, can always be disposed in a position where it substantially forms a tangent to the cylindrical surface of the said second roller, so that the core always passes from the rolling surface before the nip to the winding roller without impact and without stress, regardless of the diameter of the core and the oscillation of the cradle.

In the preferred embodiment, the channel is formed between the curved rolling surface and the cylindrical surface of the first winding roller, but different solutions and configurations, as proposed in the application PCT/IT94/00031, are not excluded.

The distance between the centres of the first and second rollers may be fixed or variable during the processing of a type of log with a core of predetermined diameter. The size of the nip between the winding rollers may be slightly less than the diameter of the core (increased by the thickness of the first windings of the web material which is wound on it before the nip is reached). In this case, the passage of the core through the nip is entirely due to the radial yielding of the core which is made of cardboard or similar. Conversely, the distance between the centres of the winding rollers may be made to vary cyclically during operation, for example by means of a cam or an electronic control system with an independent motor, or by another method known to those skilled in the art.

In a particularly advantageous embodiment of the machine according to the invention, in order to enable the machine to be adapted to winding core diameters which may vary widely, the second winding roller and the linking surface are made to be carried by a moving unit whose position with respect to the first winding roller is adjustable according to the diameter of the cores used at different times.

Similarly, the oscillating cradle and the insertion means may also be carried by a moving unit whose position with respect to the first winding roller is variable to adapt the size of the channel to the diameter of the core.

With this arrangement, it is possible to produce on the same machine either logs for the production of toilet paper or similar for domestic use, or logs for the production of what are known as industrial rolls, normally provided with winding cores of considerably greater diameter which is variable over a wider range of values.

Further advantageous characteristics and preferred embodiments of the rewinding machine according to the invention are described in the following text and are indicated in the attached claims.

BRIEF DESCRIPTION OF THE DRAWINGS

The invention will be more clearly understood from the description and the attached drawing which shows an embodiment, provided by way of example and without restriction, of the invention. In particular, in the drawing.

DESCRIPTION OF THE PREFERRED EMBODIMENT

Figure 1:
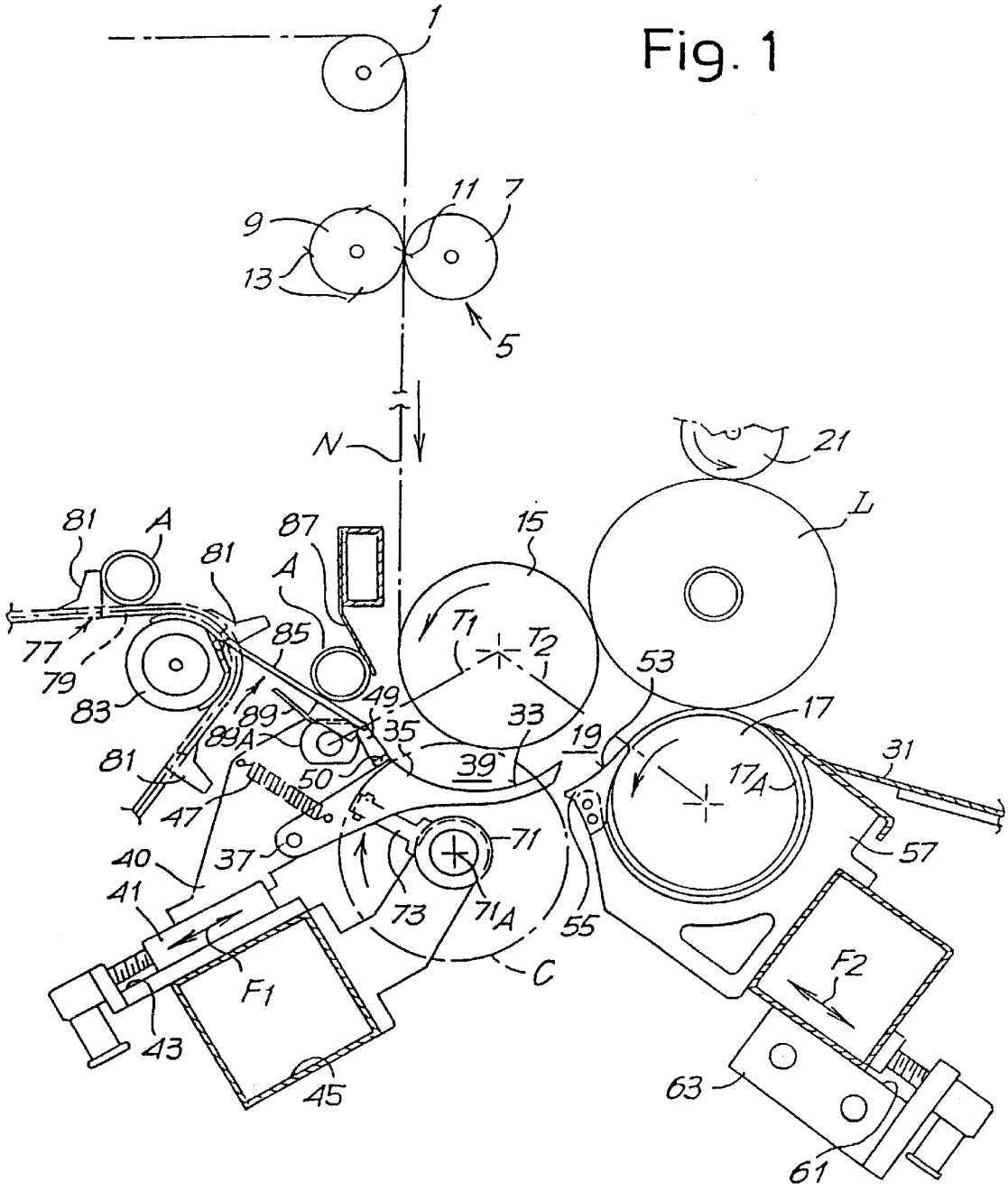
FIGS. 1 to 6 are schematic side views of six successive stages of an operating cycle of the rewinder according to the invention.

The rewinder has a set of rollers for feeding the web material N, only one of which is visible in FIG. 1 and is indicated there by the number 1. The web material, typically paper in one or more plies, is fed at high speed (of the order of 400–1000 m/min.) through a perforating unit, indicated in a general way by 5, comprising (in the illustrated example) a fixed support 7 and a rotating cylinder 9. The fixed support carries a counter-blade 11 interacting with a plurality of blades 13 carried by the rotating cylinder 9.

A first winding roller 15, around which the web material N is run, and a second winding roller 17 are disposed after the perforating unit 5. The two rollers 15 and 17 rotate in the same direction (anti-clockwise in the figures). They form a nip 19 through which the web material N is fed. The number 21 indicates a third roller rotating in the same direction as the rollers 15 and 17 and carried by an oscillating arm 23 hinged to the structure of the machine. An actuator 27 controls the oscillation of the arm 23 to permit the control of the growth of the log being wound in the machine.

The winding rollers 15, 17 and 21 form the area where the winding of each individual log is completed according to the procedures described in the following text.

After the winding rollers there is disposed a slide 31 along which the completed logs L are made to roll and are guided towards gluing means which are not shown and are known to those skilled in the art.

Before the nip 19 there is disposed a curved rolling surface 33 consisting of an oscillating cradle 35 formed from a plurality of parallel strips which form a comb-shaped structure, for the purposes stated below. The oscillating cradle 35 forms, together with the cylindrical surface of the first winding roller 15, a channel 39 into which the winding cores are inserted in succession. The oscillating cradle 35 is hinged at 37 to a moving unit 40 carried by a sliding block 41 whose position is adjustable along a guide 43 carried by a cross-piece 45 integral with the supporting structure of the machine. The oscillating cradle 35 is acted on elastically by an elastic member 47 which pushes the oscillating cradle 35 into a position in which it bears on a receiving element 49 forming the first entrance portion of the channel 39, and is provided with a damping element made of elastomeric or similar material. The receiving element 49 is integral with the moving unit 40 and forms the initial entrance portion of the surface 33. The radius of curvature of the entrance portion of the said surface is approximately equal to the radius of the first winding roller 15 plus the minimum diameter of the core, reduced by a few millimetres (approximately 2 to 5 mm) to ensure a sufficient forcing of the core against the winding roller 15 in any operating conditions.

The oscillating cradle 35 and the rolling surface 33 do not extend as far as the nip 19, but are interrupted at a certain distance from it. The second winding roller 17 is associated with a linking surface 53 consisting of a plurality of parallel strips 55 spaced apart to form a comb-shaped structure similar to the structure of the oscillating cradle 35. The strips 55 forming the comb-shaped structure extend into annular channels 17A in the roller 17 so that the surface 53 formed by the strips 55 provides a continuous link to the cylindrical surface of the roller 17.

The strips 55 forming the linking surface 53 are carried by a moving unit 57 which also carries the second winding roller 17. The moving unit 57 is integral with a sliding block 59 whose position is adjustable along a guide 61 which is integral with a cross-piece 63 carried by the fixed structure of the machine. The adjustment of the position of the sliding block 59 and consequently of the moving unit 57 changes the centre spacing of the winding rollers 15 and 17 and consequently the size of the nip 19 formed between them.

A rotating element 71 carrying means 73 of interrupting the web material N, these means interacting with the cylindrical surface of the winding roller 15, is disposed under the strips 35 forming the rolling surface 33. In this embodiment, the interrupting means 73 are in the form of pressers, buffers or elastic pressure members which press lightly on the surface of the roller 15 during the stage of interruption or tearing of the web material. However, other configurations are possible, for example with plain or serrated blades, continuous or discontinuous in the direction of the axis of the roller 15, which interact with channels or counter-blades in the cylindrical surface of the roller 15.

The rotating element 71 rotates intermittently, in the clockwise direction in the example illustrated. The pressers 73 move along a theoretical cylindrical surface C which has a circular section and has its axis coinciding with the axis 71A of rotation of the element 71 and forming an approximate tangent to the cylindrical surface of the roller 15, or with a slight interference with the latter surface.

The cores A are inserted into the channel 39 by means of a conveyor indicated in a general way by 77, comprising a flexible continuous member 79 carrying a plurality of pushers 81 and running around a pulley 83. Along the path of the conveyor 77 there is disposed, in a way known to those skilled in the art, a gluing device which applies an adhesive to each core in defined areas, particularly in annular areas. The cores A are discharged from the conveyor 77 on to a slide 85 whose lower end is fixed to or rests on the unit 40 to guide the cores towards the channel 39. An elastic retaining member 87 is disposed in front of the slide 85, and retains the core on the slide 85 in a position from which the core is pushed into the channel 39 at the appropriate time by a pusher 89 rotating intermittently about its own axis of rotation 89A.

The operation of the machine described above is as follows.

FIG. 1 shows the terminal stage of winding of a log L. The first winding roller 15, the second winding roller 17 and the third winding roller 21 rotate with the same peripheral speed, equal to the speed of the feed of the web material N. A new core A has been discharged from the conveyor 77 on to the slide 85 and is retained by the retaining member 87.

Figure 2:
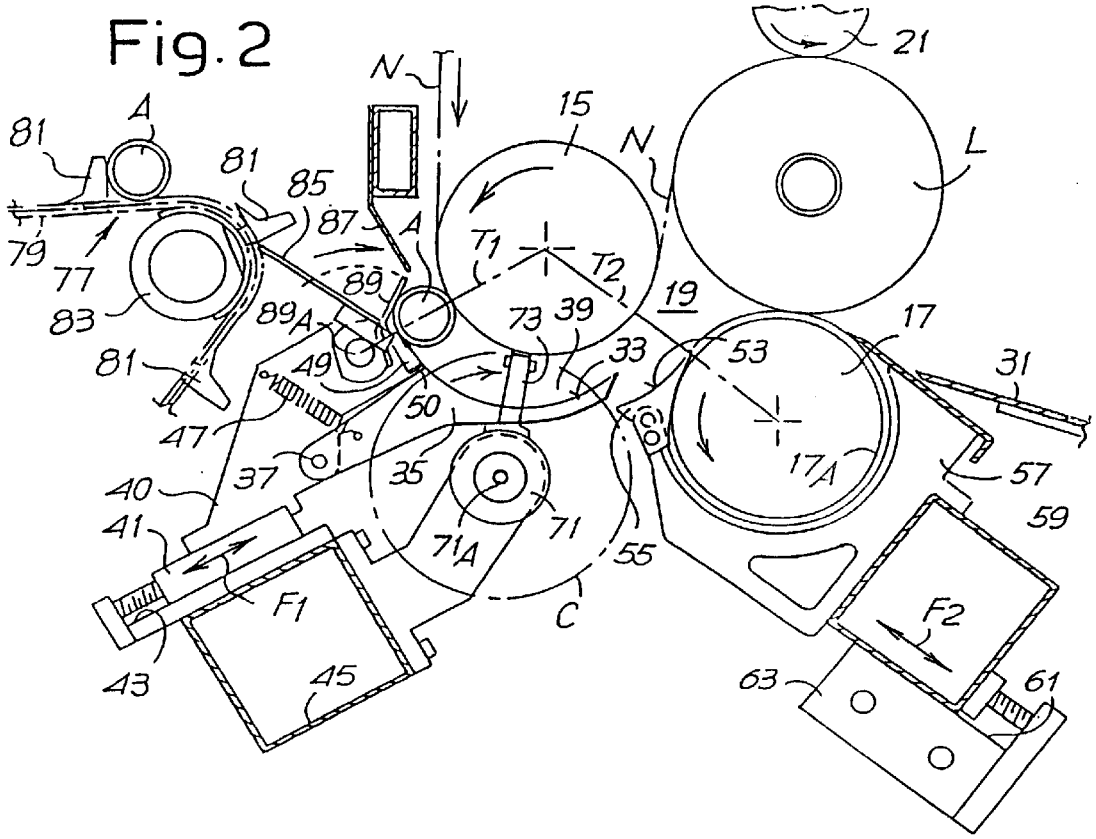

FIG. 2 shows the start of the exchange operation, in other words the substitution of a new core for the log whose winding has been completed. For this purpose, the speed of the second winding roller 17 is decreased, and at the same time the rotating element 71 is made to rotate about the axis 71A and the pusher 89 is made to rotate about the axis 89A. This change of state has the following effects:

the completed log L begins to move away from the first winding roller 15 as a result of the difference in peripheral speeds between the roller 15 and the roller 21;

the means 73 of interrupting the web N penetrate between the strips forming the oscillating cradle 35 until they come into contact with the web material N, pinching this between the means 73 and the cylindrical surface of the winding roller 15;

the pusher 89, which may advantageously be controlled by the same actuator as that which rotates the rotating element 71, releases the core A from the retaining member 87 and forces it into the entrance of the channel 39, whose transverse dimension is advantageously slightly smaller than the external diameter of the core.

Figure 3:
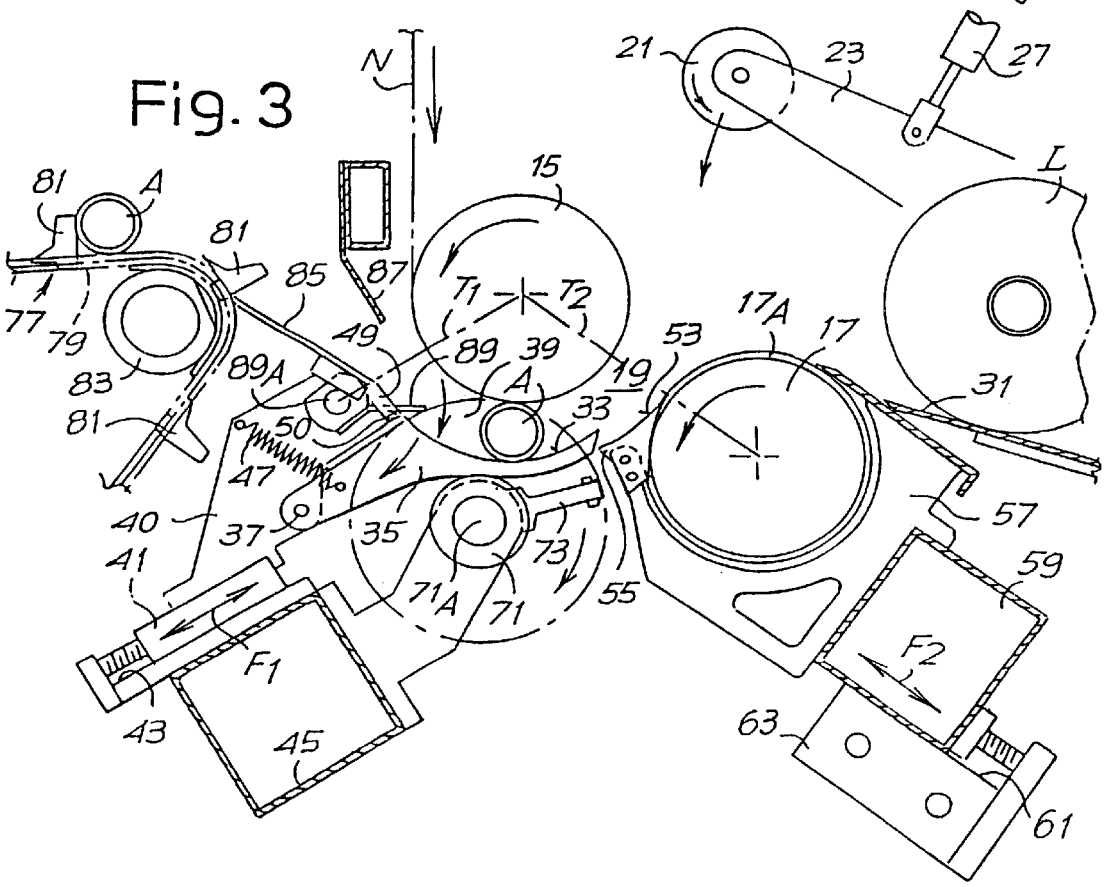

The peripheral speed of the means 73 of interrupting the web material N is slightly lower than the speed of the feed of the web material, and therefore also slightly lower than the peripheral speed of the winding roller 15. Consequently, the web material N is torn at a point lying between the completed log L and the point of pinching between the means 73 and the roller 15. In this way a free edge of web material is generated and adheres to the core A, which in the meantime has begun to rotate in the channel 39 (FIG. 3). The operation described up to this point does not differ substantially from that illustrated in PCT/IT94/00031.

Figure 4:
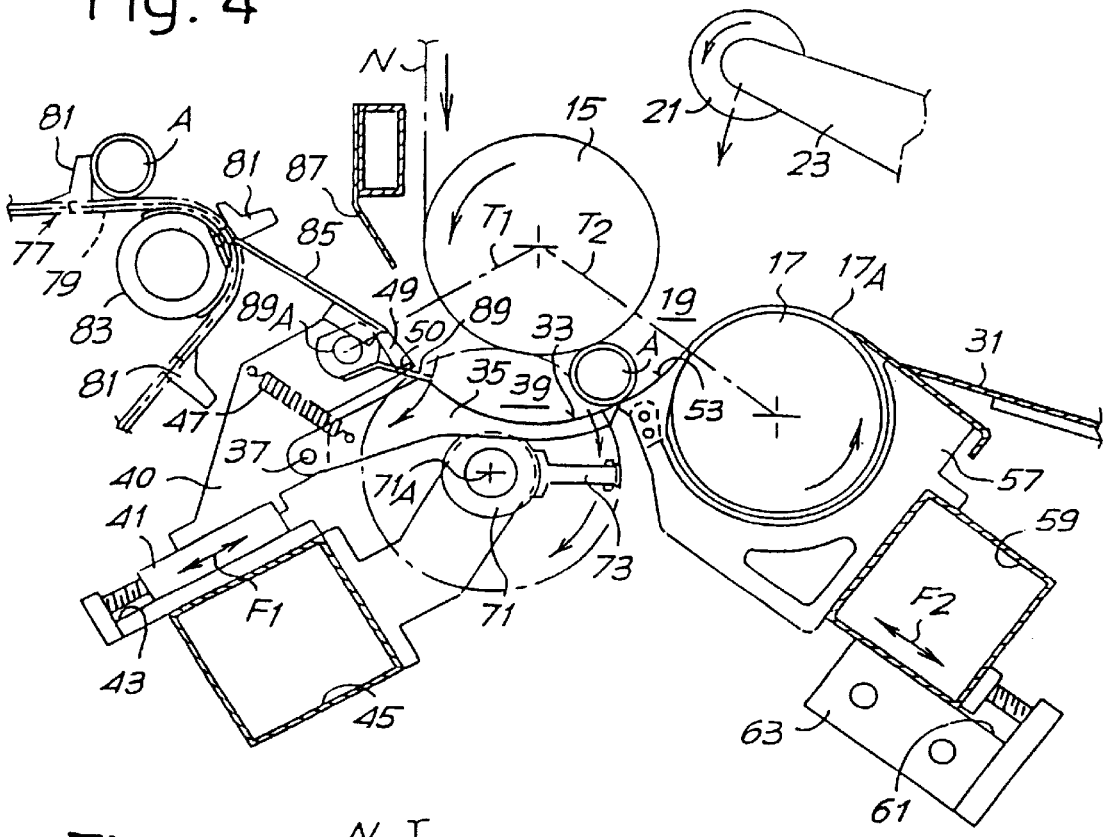
Figure 5:
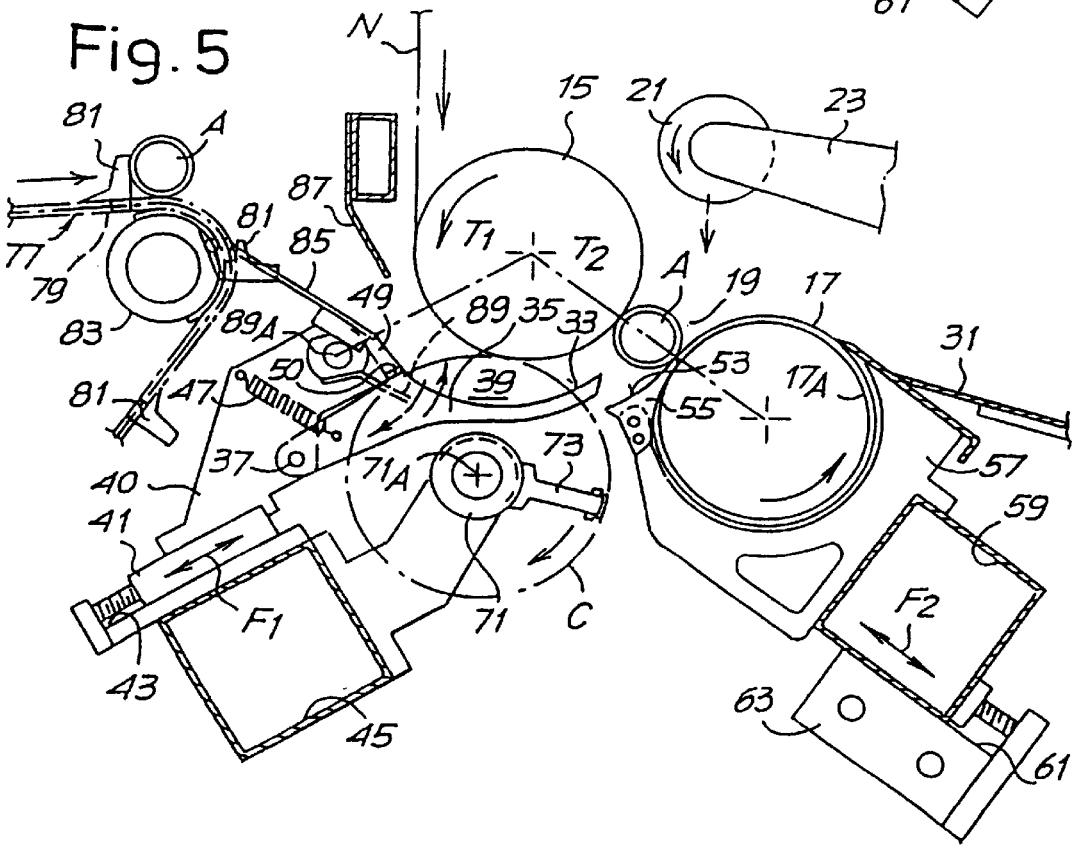

The surface 33 formed by the oscillating cradle 35 has a curvature and position such that the channel 39 tapers from the entrance towards the nip 19. The capacity of the cradle 35 to oscillate with the yielding of the elastic member 47 enables the channel 39 to be adapted to the size of the core in transit. Variations in the diameter of the core are therefore compensated by a greater or lesser oscillation of the cradle 35, so that the rewinding machine can operate with cores of different diameters without requiring any intervention on the oscillating cradle 35. The linking surface 53 is positioned in such a way that when the core is at the final edge of the rolling surface 33 it can continue to roll continuously on to the linking surface 53 and from this to the second winding roller 17, as may be seen in the sequence illustrated in FIGS. 4 and 5.

When the core A leaves the rolling surface 33, the oscillating cradle 35 is pushed by the elastic return member 47 into the position in which it bears on the damping members 49. These attenuate the impact and reduce to a minimum the noise and mechanical stress. It is possible to make the strips forming the oscillating cradle 35 of elastic material in such a way that it is the strips themselves that deform elastically to allow the core to pass. The term "oscillating cradle" includes a cradle made in this way, in other words one in which the oscillation is obtained by the elastic deformation of the members forming the cradle.

Moreover, positive control of the oscillations of the cradle 35, using a cylinder and piston actuator or electronic cam or similar, may be provided instead of an elastic return system.

Figure 6:
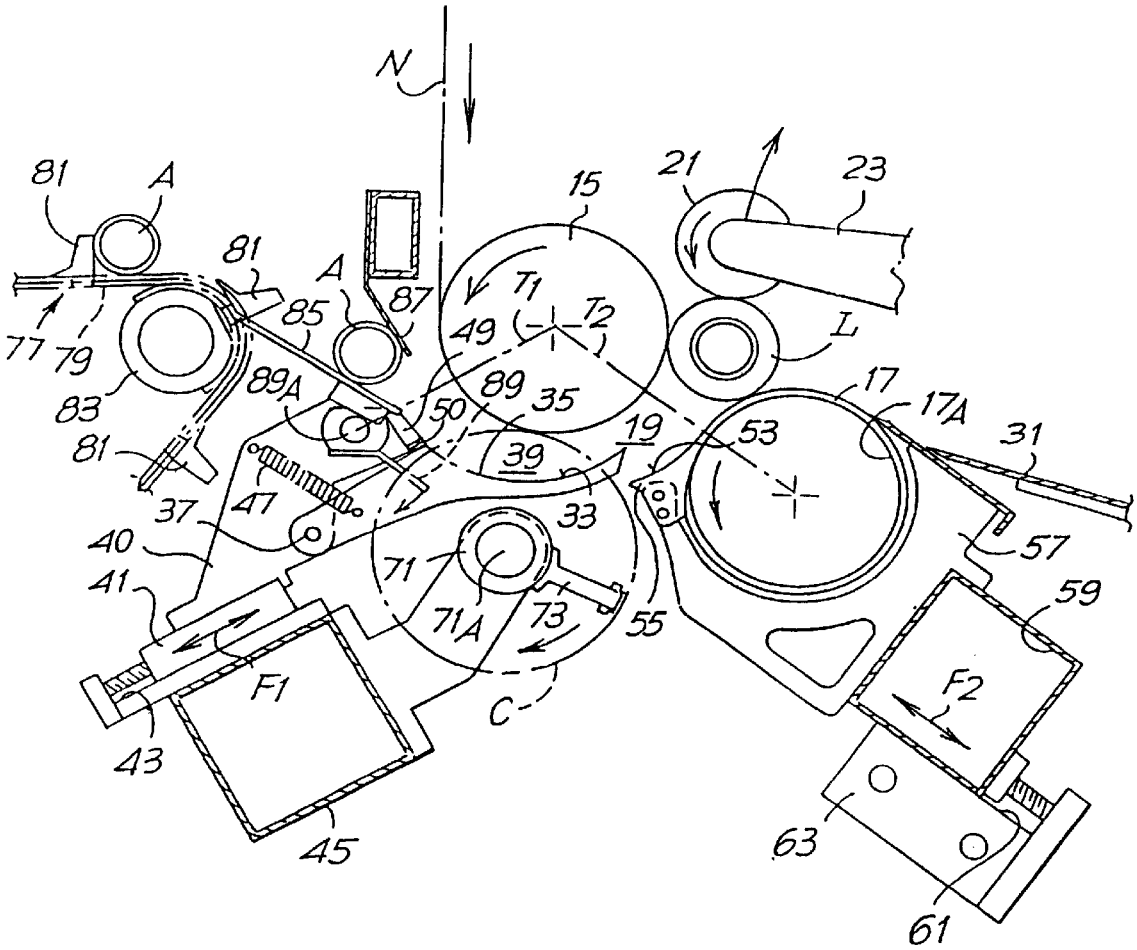

When the core has entered the nip 19, it passes through this nip as a result of the difference in speed between the winding rollers 15 and 17, and then comes into contact with the third winding roller 21, which has been lowered in the meantime (FIG. 6). When the traversing of the core (with the first windings of web material wound on it) through the nip 19 has been completed, the peripheral speed of the winding roller 17 may be returned to the normal operating speed, equal to the speed of the feed of the web material N. FIG. 6 shows the intermediate state in which the log L in formation is in contact with the three rollers. The rotation of the rotating element 71 and the pusher 89 may stop at the same time, these stopping approximately in the angular positions shown in FIG. 1. They remain in this position until the start of a new exchange cycle on completion of the winding of the new log.

Figure 7:
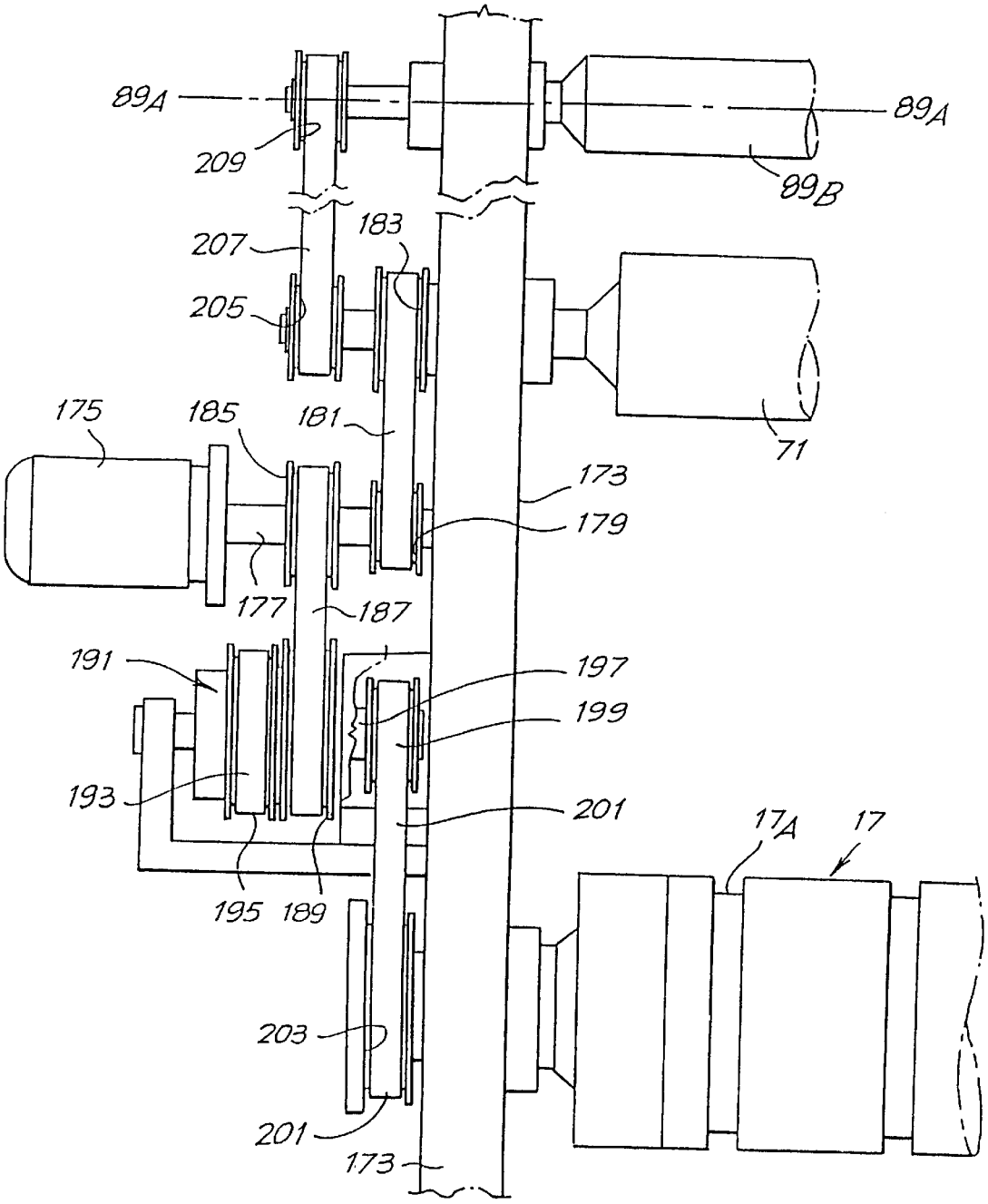
FIG. 7 is a kinematic diagram of a possible mechanism for controlling the core insertion means and for interrupting the web material.

It will be noted that the operations of deceleration of the second winding roller 17, of rotation of the rotating element 71 and of rotation of the pusher 89 take place substantially simultaneously. This makes it possible to use a single electronically controlled actuator to activate the above three functions. FIG. 7 shows, for guidance, a section of a particularly advantageous embodiment of the control mechanisms for the above members.

In FIG. 7, the number 173 indicates the side of the machine, on which are supported, together with other parts, the second winding roller 17, the rotating element 71 and the cylinder 89B (with the axis 89A) supporting the pusher 89. The number 175 indicates a motor which forms the actuator of the rotating element 71. A first toothed pulley 179, on which a toothed belt 181 runs and transmits the motion through a further pulley 183 to the rotating element 71, is keyed to the shaft 177 of the motor 175. A second toothed pulley 185, keyed to the shaft 177, transmits the motion through a toothed belt 187 to a toothed pulley 189. The pulley 189 is keyed to a first input axle of an epicyclic gear indicated in a general way by 191. The casing or spider of the epicyclic gear 191 is integral with a pulley 193 around which runs a belt 195 which takes the motion from a member of the machine, not shown, rotating at a speed proportional to the speed of the feed of the web material N. The said member may consist of any of the rollers for guiding and feeding the web material, for example the winding roller 15. The number 197 indicates the output axle of the epicyclic gear 191. A toothed pulley 199 which, through a toothed belt 201, transmits the motion to a toothed pulley 203 keyed to the shaft of the second winding roller 17, is keyed to the said output axle.

A further pulley 205 which, through a belt 207, transmits the motion to a pulley 209 keyed on the shaft 89B of the pusher 89, is keyed to the shaft of the rotating element 71. In the stage of winding of the log L between the rollers 15, 17 and 21, the motor 175 is stationary. The winding roller 17 is made to rotate directly by the belt 195. The transmission ratio of the differential and of the pulleys used is such that a peripheral speed of the roller 17 equal to the peripheral speed of the roller 15 is obtained. When the winding of the log L is almost completed, the motor 175 is made to rotate. This causes the following effects: it makes the rotating element 71 carrying the means of interruption 73 rotate; it makes the supporting shaft 89B of the pusher 89 rotate; it changes the transmission ratio between the pulley 193 and the winding roller 17 as a result of the rotation of the input half-shaft of the differential 191. The change of the transmission ratio between the pulley 193 and the roller 17 causes a deceleration of the latter and consequently a reduction of its peripheral speed with respect to the peripheral speed of the roller 15. This deceleration is sufficient to discharge the newly completed log L.

However, it is possible to use different and independent drives for the various members. It is also possible to consider the use of a winding roller 17 which rotates constantly at a speed lower than that of the winding roller 15. Furthermore, it is possible for the roller 21 not to be rotated at constant speed. It could also accelerate during the exchange, with a consequent effect of tensioning the web material occurring before the intervention of means of interruption.

To adapt the machine to a different core diameter, it is sufficient to adjust the position of the unit 40 and the unit 57. The oscillating cradle 35 does not have to be replaced, since it can be easily adapted to any core diameter. The adjustment of the position of the unit 40 enables the size of the entrance of the channel 39 to be adapted.

Instead of a sliding block 59 whose position is adjustable and which carries the unit 57 supporting the winding roller 17 and the linking surface 53, it is possible to provide a system in which the position of the lower winding roller 17 is controlled by an electronic cam or by an electronically controlled actuator. The winding roller 17 may thus be moved even during each winding cycle, for example in order to change the size of the nip 19 during the transit of the core A. In this case, the adaptation to the diameters of the individual cores may be carried out by an intervention in the machine control program, possibly through the control panel.

The adjustments of the unit 40 and the unit 57 may also be carried out rapidly and precisely by providing for example a system of adjustment with a threaded rod and an electronically controlled motor, as indicated schematically in FIG. 1. In this way the individual positions of the members of the machine may easily be changed from the control panel, using, if necessary, data stored for different core diameters.

The movement of the adjustment of the unit 40 may advantageously take place in a direction F1 (FIG. 1) parallel to a plane passing through the line T1, containing the axis of the winding roller 15 and of the roller 89B supporting the pusher 89. Conversely, the adjustment of the unit 57 takes place in a direction F2 parallel to a plane passing through the line T2 containing the axes of the two winding rollers 15 and 17.

When the core diameters vary over a very wide range, the size of the pusher 89 may be adjusted radially (for example by making it in two telescopically sliding parts which may be locked in any position with respect to each other), in such a way that it never interferes with the winding roller 15 but still securely grips the core, regardless of its diameter.

It is to be understood that the drawing shows only an example provided solely as a practical demonstration of the invention, and that this invention may be varied in its forms and dispositions without departure from the scope of the guiding concept of the invention. Any presence of reference numbers in the attached claims has the purpose of facilitating the reading of the claims with reference to the description and to the drawing, and has no limiting effect on the scope of protection.

I claim:

1. A rewinding machine for the formation of logs of web material wound on a core comprising:

a first winding roller around which the web material is run;

a second winding roller forming, together with the first winding roller, a nip through which the core and the web material are made to pass;

a feeder to feed the web material into the nip, said feeder having a speed of advance substantially equal to speed of feeding of the web material;

an inserter to insert a core on which the web material is to be wound;

before the nip, with respect to a direction of advance of the web material, a rolling surface forming, together with the feeder, a channel into which the core is inserted;

an interrupter of the web material, which interacts with the feeder in an intermediate position along the channel, between a point of insertion of a new core and the nip, said interrupter also acting to sever the web material in an intermediate position along the channel;

wherein the rolling surface forming the channel is at least partially formed by an oscillating cradle.

2. A rewinding machine for the formation of logs of web material wound on a core comprising:

a first winding roller around which the web material is run;

a second winding roller forming, together with the first winding roller, a nip through which the core and the web material are made to pass;

a feeder to feed the web material into the nip, said feeder having a speed of advance substantially equal to speed of feeding of the web material;

an inserter to insert a core on which the web material is to be wound;

before the nip, with respect to a direction of advance of the web material, a rolling surface forming, together with the feeder, a channel into which the core is inserted;

an interrupter of the web material, which interacts with the feeder in an intermediate position along the channel, between a point of insertion of a new core and the nip, said interrupter also acting to sever the web material in an intermediate position along the channel;

wherein the rolling surface forming the channel is at least partially formed by an elastically deformable cradle.

3. A rewinding machine for the formation of logs of web material wound on a core comprising:

a first winding roller around which the web material is run;

a second winding roller forming, together with the first winding roller, a nip through which the core and the web material are made to pass;

a feeder to feed the web material into the nip, said feeder having a speed of advance substantially equal to speed of feeding of the web material;

an inserter to insert a core on which the web material is to be wound;

before the nip, with respect to a direction of advance of the web material, a rolling surface forming, together with the feeder, a channel into which the core is inserted;

an interrupter of the web material, which interacts with the feeder in an intermediate position along the channel, between a point of insertion of a new core and the nip;

wherein the rolling surface forming the channel is at least partially formed by an oscillating cradle; and further wherein the rolling surface is divided into at least two parts, a first part of which is formed by the oscillating cradle, while a second part is formed by a linking surface which is fixed with respect to the axis of the second winding roller.

4. A rewinding machine for the formation of logs of web material wound on a core comprising:

a first winding roller around which the web material is run;

a second winding roller forming, together with the first winding roller, a nip through which the core and the web material are made to pass;

a feeder to feed the web material into the nip, said feeder having a speed of advance substantially equal to speed of feeding of the web material;

an inserter to insert a core on which the web material is to be wound;

before the nip, with respect to a direction of advance of the web material, a rolling surface forming, together with the feeder, a channel into which the core is inserted;

an interrupter of the web material, which interacts with the feeder in an intermediate position along the channel, between a point of insertion of a new core and the nip;

wherein the rolling surface forming the channel is at least partially formed by an elastically deformable cradle; and further wherein the rolling surface is divided into at least two parts, a first part of which is formed by the elastically deformable cradle, while a second part is formed by a linking surface which is fixed with respect to the axis of the second winding roller.

5. The rewinding machine as claimed in claim 1, or 3 wherein an entrance element forming an initial entrance portion of the channel is disposed before the oscillating cradle.

6. The rewinding machine as claimed in claim 2 or 4 wherein an entrance element forming an initial entrance portion of the channel is disposed before the elastically deformable cradle.

7. The rewinding machine as claimed in claim 1, 2, 3 or 4 wherein the channel is formed by the rolling surface and the first winding roller, and the rolling surface is curved.

8. The rewinding machine as claimed in claim 1, 2, 3 or 4 wherein distance between a center of the first winding roller and a center of the second winding roller is variable.

9. The rewinding machine as claimed in claim 1, 2, 3 or 4 wherein the second winding roller and the linking surface are carried by a moving unit whose position with respect to the first winding roller is adjustable.

10. The rewinding machine as claimed in claim 1 or 3 wherein the oscillating cradle is carried by a moving unit whose position with respect to the first winding roller is variable.

11. The rewinding machine as claimed in claim 2 or 4 wherein the elastically deformable cradle is carried by a moving unit whose position with respect to the first winding roller is variable.

12. The rewinding machine as claimed in claim 10 wherein the moving unit carries the inserter to insert an individual core into the channel.

13. The rewinding machine as claimed in claim 11 wherein the moving unit carries the inserter to insert an individual core into the channel.

14. The rewinding machine as claimed in claim 12 further comprising a conveyor which feeds cores towards the first winding roller and the second winding roller with the conveyor discharging the cores onto a slide disposed between a discharge end of the conveyor and the inserter, wherein position of the slide is determined according to position of the moving unit.

15. The rewinding machine as claimed in claim 13 further comprising a conveyor which feeds cores towards the first winding roller and the second winding roller with the conveyor discharging the cores onto a slide disposed between a discharge end of the conveyor and the inserter, wherein position of the slide is determined according to position of the moving unit.

16. The rewinding machine as claimed in claim 10 wherein dimensions of the inserter are adjustable.

17. The rewinding machine as claimed in claim 11 wherein dimensions of the inserter are adjustable.

18. The rewinding machine as claimed in claim 1 or 3 wherein the oscillating cradle is associated with an elastic return which urges the oscillating cradle towards a position in which size of the channel is smallest.

19. The rewinding machine as claimed in claim 2 or 4 wherein the elastically deformable cradle is associated with an elastic return which urges the elastically deformable cradle towards a position in which size of the channel is smallest.

20. The rewinding machine as claimed in claim 18 wherein the oscillating cradle is associated with a damper to damp impact in the elastic return of the oscillating cradle after passage of each individual core through the channel.

21. The rewinding machine as claimed in claim 19 wherein the elastically deformable cradle is associated with a damper to damp impact in the elastic return of the elastically deformable cradle after passage of each individual core through the channel.

22. The rewinding machine as claimed in claim 3 or 4 wherein the second winding roller is provided with annular grooves and the linking surface is formed by a comb-shaped structure which partially penetrates into the annular grooves.

* * * * *